US007270088B2

(12) United States Patent
Whitehall

(10) Patent No.: US 7,270,088 B2
(45) Date of Patent: Sep. 18, 2007

(54) SYSTEM AND METHOD FOR STORAGE AND DELIVERY OF A FUEL ADDITIVE TO A FUEL TANK

(76) Inventor: William Trace Whitehall, P.O. Box 4944, Buena Vista, CO (US) 81211

( * ) Notice: Subject to any disclaimer, the term of this patent is extended or adjusted under 35 U.S.C. 154(b) by 308 days.

(21) Appl. No.: 11/075,344

(22) Filed: Mar. 8, 2005

(65) Prior Publication Data

US 2006/0201574 A1 Sep. 14, 2006

(51) Int. Cl.
*F02B 47/00* (2006.01)
*F02M 25/00* (2006.01)

(52) U.S. Cl. ..... 123/1 A; 123/514; 123/198 A

(58) Field of Classification Search ..... 123/1 A, 123/497, 514, 198 A
See application file for complete search history.

(56) References Cited

U.S. PATENT DOCUMENTS 3,620,424 A 11/1971 Grigsby
4,096,829 A * 6/1978 Spears ..... 123/25 J
4,161,160 A 7/1979 Hicks et al.
4,253,436 A 3/1981 Dudrey
4,300,485 A * 11/1981 Goodman ..... 123/25 J
4,346,689 A * 8/1982 Neely ..... 123/575
4,364,370 A * 12/1982 Smith et al. ..... 123/575
4,422,413 A * 12/1983 Pederson ..... 123/25 J
4,557,221 A * 12/1985 Kamel et al. ..... 123/1 A
4,568,248 A * 2/1986 Harders ..... 417/43
4,621,593 A 11/1986 Rao et al.
4,936,261 A 6/1990 Naumann et al.
5,421,295 A 6/1995 Lemaire et al.
5,476,073 A 12/1995 Betts
5,992,473 A 11/1999 Hammonds
6,068,672 A 5/2000 Watson et al.
6,135,719 A * 10/2000 Yoder et al. ..... 417/43
6,135,724 A * 10/2000 Yoder et al. ..... 417/286
6,276,310 B1 8/2001 Backes et al.
6,422,266 B1 7/2002 Gouzou et al.
7,066,353 B2 * 6/2006 Hammonds ..... 222/63

FOREIGN PATENT DOCUMENTS

GB 2176842 * 1/1987

* cited by examiner

*Primary Examiner*—Hai Huynh
(74) *Attorney, Agent, or Firm*—Lathrop & Gage LC

(57) ABSTRACT

A system for storage and delivery of a fuel additive to a fuel tank includes a reservoir in fluidic communication with a volumetric pump, through a tubular member such as a steel-braided hose. The pump is in further fluidic communication with the fuel return line of a vehicle, via another tubular member, such as a steel-braided hose. Valves disposed along the fluidic pathway prevent backflow of additive. The pump is electrically connected to and actuated by a timer, the timer calibrated to a rate of the pump to provide a predetermined amount of fuel additive necessary to treat an amount of fuel added to the fuel tank of the vehicle. A user interface with user-selectable, volumetric settings and control switches is electrically connected to the timer. A related method of adding a fuel additive to the fuel tank of a vehicle is also disclosed.

20 Claims, 3 Drawing Sheets

SYSTEM AND METHOD FOR STORAGE AND DELIVERY OF A FUEL ADDITIVE TO A FUEL TANK

FIELD OF THE INVENTION

The present invention relates generally to the treatment of fuel for automotive engines, and more particularly, to improved systems and methods for storing and delivering fuel additives to the fuel tanks of diesel engines.

BACKGROUND

Modem engine technology, including diesel technology, is being held to increasingly strict emissions standards, as the Environmental Protection Agency (E.P.A.) introduces its Tier 2 regulations in an effort to curb automotive pollution. For example, new emissions standards set by the E.P.A. and scheduled to phase in from 2004 to 2009 require substantial reductions in emissions of particulate matter, nitrogen oxides and sulfur from diesel engines.

The E.P.A. has proposed a cap of 15 parts per million (ppm) of sulfur in diesel fuel beginning in 2006. Currently, the cap is set at 500 ppm. This has led to a new class of ultra-low-sulfur diesel (ULSD) fuels with levels of 50 ppm sulfur or less. ULSD fuel has been proposed as a technology enabler to pave the way for advanced, sulfur-intolerant exhaust emission control technologies; however, ULSD fuel is not without drawbacks.

First, ULSD fuel is produced through additional hydroprocessing and higher-severity hydrotreating of fuel. These processes reduce sulfur levels; however, in doing so, they adversely affect beneficial fuel properties. For example, the removal of sulfur- and hydrocarbon-based polar molecules during hydroprocessing may rob the fuel of the natural lubricity provided by these compounds. Low-lubricity fuels can result in premature wear and failure of fuel system components.

Additionally, severely hydrotreated fuels may be depleted of natural antioxidants that help prevent the fuel from forming gums and sludges. Furthermore, ULSD fuel can be more corrosive than conventional fuels.

Many chemical fuel additives have been developed to counteract the above-mentioned negative aspects of ULSD fuel. For example, a consumer may purchase fuel additive de-icers and depressants, as well as fuel additives designed to lubricate, clean, regulate viscosity and boost cetane levels. These additives may extend the life and enhance the performance of a diesel engine, and may further reduce emissions, thus aiding drivers in meeting increasingly stringent E.P.A. emission standards. However, for the average driver, conventional methods of including such fuel additives in a fuel tank are messy, inconvenient, time-consuming and potentially hazardous.

Currently, fuel additives are either introduced into bulk storage tanks from which fleet vehicles are fueled, or poured directly into vehicle fuel tanks from consumer-oriented packages (i.e., cans, bottles and the like). Most of the supplemental additives used in diesel fuel do not have a residual affect and must be supplied to each tank of fuel, especially chemicals such as flow improvers and deicers used in cold weather. Furthermore, fuel additives are commercially available in particular package sizes that are not necessarily the correct dose for each and every diesel vehicle.

Thus, the operator of a passenger or larger diesel vehicle that is not fueled from a bulk tank must often carry containers of fuel additive inside their vehicles and must treat every tank of fuel piped into the vehicle. Introducing a fuel additive into the fuel tank takes time, as the operator must locate the container of additive, calculate the amount of additive required for the vehicle in question, and then feed the additive into the tank. Furthermore, a funnel is usually required to feed fuel additives into a fuel tank. Both the funnel and the fuel additive containers can drip dangerous chemicals onto the hands, body or clothing of the vehicle's operator. Funnels and additive containers can also leak dangerous chemicals and fumes inside the vehicle. This causes problems even when the operator stores the additive containers in a trunk of the vehicle, as any leakage can damage other goods stored in the trunk. However, storing additives inside the vehicle may be particularly hazardous when the vehicle in question is an SUV or a van lacking a trunk or outside storage area. The operator of such a vehicle essentially rides with the chemicals and/or fumes in the passenger compartment, which may or may not be sufficiently ventilated to disperse chemical fumes into the outside air.

Hence, there remains a need for a fuel additive storage system that is contained outside of the passenger compartment, that is convenient to operate and that supplies an optimal amount of fuel additive in a proper dosage for a specific vehicle.

SUMMARY

The system and methods described below address the problems outlined above and advance the art by providing a system and method for storage and delivery of a fuel additive to a fuel tank.

In one embodiment, the system includes a reservoir for storing the fuel additive for delivery, and a pump that is operable to pump the fuel additive. The pump has a rate of output that is within an effective range for delivery of the fuel additive. As used herein, the effective range is within 10 percent (%) of the optimal rate of output for delivery of the fuel additive. The system also includes a first tubular member for placing the pump in fluidic communication with the reservoir to deliver fuel additive from the reservoir to the pump when the pump is operating to deliver the fuel additive. A second tubular member is included for establishing fluidic communication between the pump and a fuel return line of a vehicle, to deliver the fuel additive to the fuel return line and the fuel tank when the pump is operating for delivery of the fuel additive. The first tubular member may include a check valve that prevents reverse flow of additive, The second tubular member may include a self-sealing, piercing valve for coupling the second tubular member with the fuel return line to establish a fluidic pathway. A particular preferred tubular member for these purposes is a steel braided hose covered with an insulator material.

In a further embodiment, the reservoir has an additive portal for adding the fuel additive; a removable, vented cap for opening and closing the additive portal; a check valve seal, functional to prevent fumes from escaping from the reservoir while allowing suction from the pump to draw air into the reservoir; and a drain portal for draining the contents of the reservoir.

In another embodiment, a timer may be electrically connected to the pump for actuation of the pump, to provide a volumetric output from the pump according to a predetermined amount of fuel additive that is needed for combination with fuel in the fuel tank. A user interface provides control of the timer. The user interface has a plurality of user-selectable settings configured to provide the predetermined amount of additive as a user-selectable value. Each user-selectable setting identifies an amount of fuel requiring fuel additive, and the user interface further includes a dial that a user may position to select one of the user-selectable settings. For example, the user interface includes a timer dial that may be mounted in a vehicle's driver compartment, while maintaining electrical connection to the timer by electrical wiring. The timer dial includes an on/off switch, an on/off indicator light, a toggle switch and user-selectable settings, for example, volumetric settings for setting the timer dial to a setting corresponding to a volume of fuel added to a fuel tank of the vehicle. Each of the volumetric settings further corresponds to a duration of the timer. The timer is selectively adjustable, and is calibrated to the rate of output of the pump, to provide a selected pump output volume. The predetermined amount of additive is delivered by operating the pump (within the effective range) as a product of time and the rate of output. The timer also includes a rheostat mechanism.

In one embodiment, a common housing for the reservoir, the pump and the timer is provided, the second tubular member extending through the housing. The housing further includes electrical portals for at least two electrical wires configured to supply power to the system for operation of the timer and the pump. A mounting bracket configured to support the housing within a vehicle engine compartment is also included. The system may be provided as a retrofit assembly capable of being suitably installed in a predetermined model of a vehicle. The retrofit assembly includes hardware for mounting the system on a vehicle, for example, on a vehicle firewall or a fender.

A related method of operation to provide fuel additive storage and delivery to a fuel tank, includes the steps of fitting components onto a vehicle; filling the reservoir with a fuel additive; setting the timer dial at a position corresponding to a delivery value, such as an amount of fuel additive to be delivered or an amount of fuel to be treated; and operating the pump to deliver the delivery value. The components fitted onto the vehicle include a reservoir configured to store the fuel additive for delivery; a pump that is operable to pump the fuel additive; a first tubular member (e.g., steel-braided hose covered with insulating material) for placing the pump in fluidic communication with the reservoir; a second tubular member for establishing fluidic communication between the pump and a fuel return line of a vehicle; a timer that is electrically connected to the pump for actuation of the pump; and a user interface for control of the timer.

DETAILED DESCRIPTION

Figure 1:
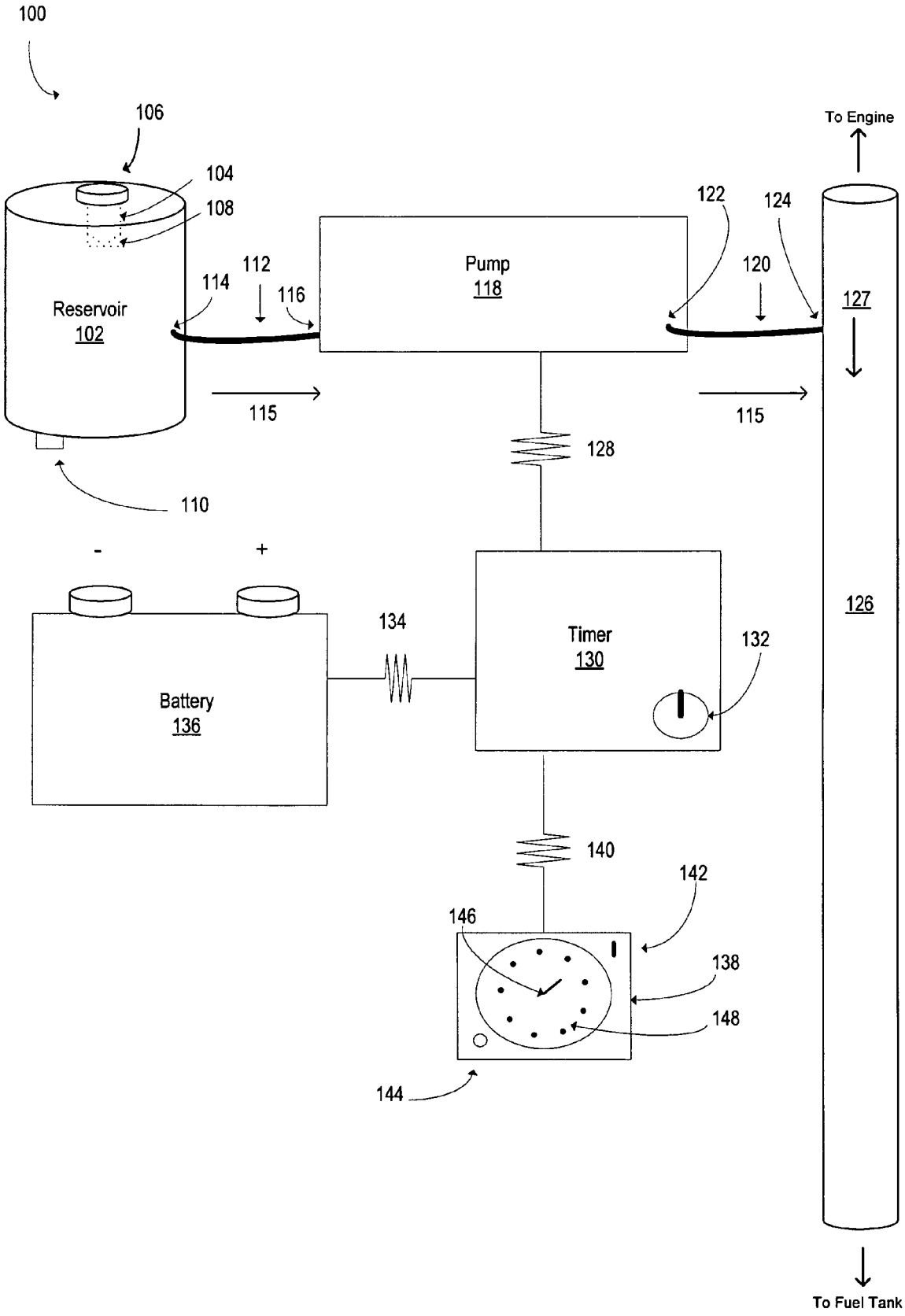
FIG. 1 shows one embodiment of the fuel additive storage and delivery system.

FIG. 1 shows a fuel additive storage and delivery system 100, including reservoir 102, connected via tubular member 112 to pump 118. Reservoir 102 includes a portal 104, with a seal 108, operable to prevent back-flow of a fuel additive. In one embodiment, seal 108 is a check valve seal that prevents additive and fumes from escaping from reservoir 102, while allowing suction from pump 118 to draw air into reservoir 102. However, it will be appreciated by those skilled in the art that alternative seals or valves may be equally utilized. Portal 104 is covered by a removable cap 106. Cap 106 may be a screw-cap, a lid or other appropriate device for covering portal 104. In a preferred embodiment, cap 106 is a vented cap that allows for the passage of air therethrough. Reservoir 102 may also include a drain portal 110, for draining the contents of reservoir 102.

Reservoir 102 is in fluidic communication with pump 118, via tubular member 112. Tubular member 112 may be a hose, a duct or other suitable apparatus for providing fluidic communication between reservoir 102 and pump 118. Pump 118 may be an impeller or positive displacement pump that fluidically communicates with the fuel return line 126 of a vehicle, via tubular member 120. It will be appreciated that in the environment of use injection of fuel additive through tubular member 120 into fuel return line 126 proceeds generally towards the fuel tank in the direction of arrow 127 because other fuel system elements (not shown) generally prevent reverse flow towards the engine. To the extent that other system components do not function effectively as a check valve in this sense, a check valve may be installed to assure flow in the direction of arrow 127. Thus, mixing of the fuel additive occurs generally in the fuel return line 126 and in the fuel tank. Tubular member 120 may be composed of the same, or different, material as tubular member tubular member 112. In a preferred embodiment, one or both of tubular members 112, 120 are steel-braided hose covered with an insulator material.

System 100 may further include one or more valves 114, 116 and 122, 124. Valves 114, 116 are disposed at the connections between reservoir 102 and tubular member 112, and between tubular member 112 and pump 218, respectively. Valves 122, 124 are respectively disposed at the connections between pump 118 and tubular member 120, and between tubular member 120 and fuel return line 126. It is to be understood and appreciated that the valves 114, 116, 122, 124 may be disposed within tubular members 112, 120.

Valves 114, 116, 122, 124 may be pressure-control valves, pressure-relief valves, check valves, or other valves suitable for preventing backflow and allowing fluidic communication from reservoir 102 through pump 118 to fuel return line 126, in the direction of flow arrows 115. When pump 118 is operating, fuel additive is pumped from reservoir 102, through valve 114 into tubular member 112, and through valve 116 into pump 118. Fuel additive continues through valve 122, through tubular member 120 and valve 124, to fuel return line 126. In a preferred embodiment, valve 124 is a self-piercing valve coupled to fuel return line 126.

Pump 118 may be a volumetric pump with a known rate of output that is within the effective range for delivery of the fuel additive from reservoir 102 to fuel return line 126. Pump 118 may be electrically connected to a timer 130, configured to deliver a predetermined amount of fuel additive by operating pump 118 at its known rate, within a suitable margin of error, for a selected amount of time. For example, timer 130 operates to deliver the predetermined amount of fuel additive according to the following equation:

$$O=rt_T \qquad \text{Eq. 1}$$

where O=volumetric output of fuel additive from pump 118; r=volumetric rate of output from pump 118, and $t_T$=selected operating time of timer 130. Furthermore, a manufacturer's recommended fuel additive dilution ratio may be expressed as 1:D where this ratio represents one part of fuel additive to D parts of fuel, such that $$D=V/O \quad \text{Eq. 2}$$

where D is defined above according to the manufacturer's recommendation, O is defined above, and V represents a volume of fuel that has been or will be added to the fuel tank and which requires additive. From this it is seen that $$t_T=V/rD \quad \text{Eq. 3}$$

In one embodiment, timer 130 is a rheostat mechanism electrically connected for control of pump 118 via one or more electrical wires 128. Timer 130 is further electrically connected to the battery 136 of a vehicle, and to a user interface 138, via one or more electrical wires 134 and 140, respectively. Timer 130 may, for example, be provided with user interface 138 as a plurality of dial settings for predetermined volumes V that are related to $t_r$ by Equation 3. User interface 138 may alternatively be a computer that permits the user to enter a volume for dilution according to Equation 3. User interface 138 maybe located in the passenger compartment of the vehicle, such as on the dashboard, under the driver's seat or near the pedals, in the engine compartment, or at other locations which are not specifically referenced herein. As shown in FIG. 1, user interface 138 optionally includes an on/off switch 142 that may be used as a manual shutoff for fuel dilution, an on/off indicator light 144, a toggle switch 146 and volumetric markings 148. Volumetric markings 148 represent a delivery value. The delivery value may be the amount of fuel added to the fuel tank of a vehicle, or the amount of fuel additive to be added to the fuel tank. In one embodiment, volumetric markings 148 represent the amount of fuel added to the fuel tank, and may range from 0.0 gallons or liters to a number commensurate with the fuel capacity of a selected vehicle or fuel tank. Toggle switch 146 may be set to a volumetric marking 148. Each volumetric marking 148 corresponds to an equivalent time of operation of timer 130 that is required to deliver the predetermined amount of fuel additive to fuel return line 126, according to Equation 1, above. On/off switch 142 may then be turned to the "on" position. On/off indicator light 144 indicates that system 100 is "on." User interface 138 electrically communicates with timer 130 via electrical wire/s 140 to activate timer trigger 132 of timer 130. Timer 130 is thus activated, and in turn electrically communicates with pump 118 via electrical wire/s 128 to actuate pump 118. Timer 130 operates for the amount of time associated with the selected volumetric marking 148. Pump 118 thus operates at its known rate until timer 130 has run for the necessary amount of time. Timer 130 may automatically turn off upon reaching the necessary amount of time, thus turning off pump 118 and ending delivery of the fuel additive.

For example, upon adding 10.1 gallons of fuel to his or her automobile, the automobile operator may move toggle switch 146 to a volumetric marking 148 labeled "10.1." The operator then turns the on/off switch of timer 138 to its "on" position. Timer trigger 132 is activated, turning timer 130 on. Timer 130 runs for the amount of time necessary to run pump 118 at its known volumetric rate to deliver the predetermined amount of fuel additive required to treat 10.1 gallons of fuel. The end of the operation time (i.e., $t_T$) of timer 130 and the delivery of the predetermined amount of fuel additive (i.e., the Output of Equation 1, within a suitable margin of error) thus occur simultaneously, and user interface 138 turns "off", for example, automatically, thus terminating operation of timer 130 and pump 118.

What constitutes a suitable margin of error may vary as a matter of system design and the particular additive that is being blended with a particular type of fuel. Generally it is recommended that the error be less than plus or minus 10% deviation from a value of 1:D, and this is preferably less than 5%. Environmental factors to be accommodated in the design include variations in the output of pump 118 as r, which may be associated with ambient temperature including viscosity of the fuel additive and the fuel. By way of example, tubular conduits connecting the various system components may be sized to reduce these variations if they have internal diameters greater than a specified value, such as one quarter inch, so as not to unduly restrict the output of pump 118. The pump 118 itself may be selected on commercial order to provide a design output within a suitable margin of error.

Certain electrical wiring and connections are described herein above; however, it will be understood and appreciated by those skilled in the art that alternate electrical relationships are within the scope of the invention. Likewise, although system 100 depicts a user interface 138 with toggle switch 146 and volumetric markings 148 for ease of explanation, it is to be understood and appreciated that alternate embodiments of a user interface may equally be utilized, including, for example, a digital interface with touch-keys or a voice-activated and voice-commanded user interface.

In addition, system 100 may be provided as a retrofit assembly, customized for a predetermined model of vehicle. The retrofit assembly may include one or more mounting apparatus, such as a bracket or brackets, for securing system components within the engine compartment of a vehicle. The retrofit assembly may optionally include a housing for one or more system components, for example, as illustrated in the embodiment of FIG. 2.

Figure 2:
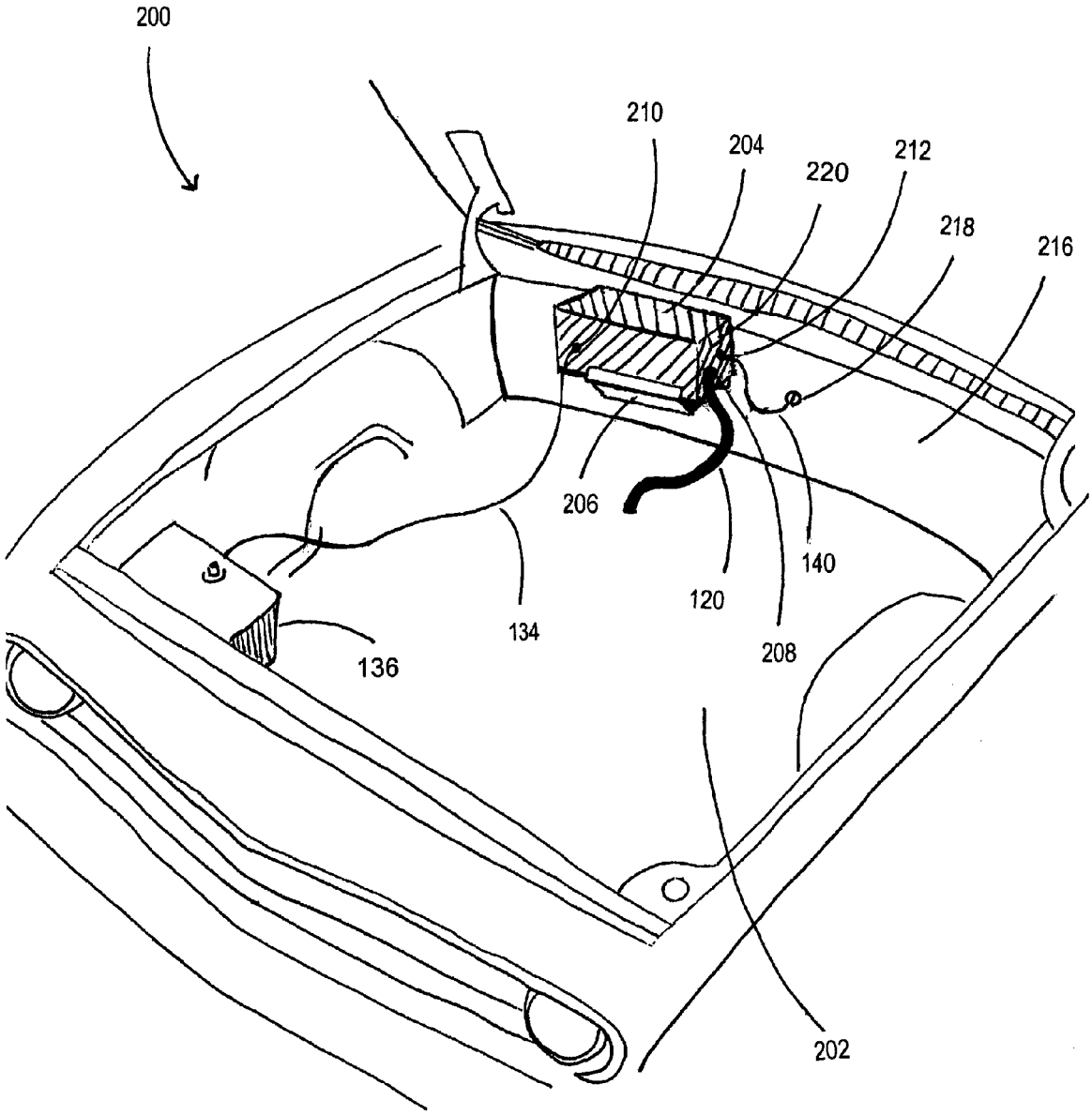
FIG. 2 is a partial view showing an embodiment of the fuel storage and delivery system within the engine compartment of a vehicle.

FIG. 2 is a partial view showing a fuel storage and delivery system 200. System 200 includes common housing 204. In a preferred embodiment, common housing 204 is a black box containing reservoir 102, tubular member 112, pump 118 and timer 130, along with additional and intervening structures (i.e., valves 114, 116 and cap 106). In the embodiment of FIG. 2, common housing 204 includes electrical portals 210 and 212 for electrical wires 134, 140, respectively. For example, electrical wire 134 connects to battery 136. Electrical wire 140 extends through a firewall portal 218, disposed in firewall 216, to connect to user interface 138, located in the driver's compartment of the vehicle. Common housing 204 also includes a portal 208 for tubular member 120. Tubular member 120 connects to the fuel return line (not shown) of the vehicle. Alternately, tubular member 120 may be partially or substantially completely housed within common housing 204, connecting to fuel return line 126 via valve 124.

Common housing 204 is attached to a selected attachment point in engine compartment 202, for example, at firewall 216 or at a fender, by mounting apparatus 206. In one preferred embodiment, mounting apparatus 206 is a bracket. The contents of common housing 204 may be accessed, for example, by unfastening latch 220 and opening common housing 204. In an alternate embodiment, cap 106 and drain portal 110 of reservoir 102 may extend through additional portals in common housing 204, thus allowing for filling and draining of reservoir 102 without opening common housing 204.

Figure 3:
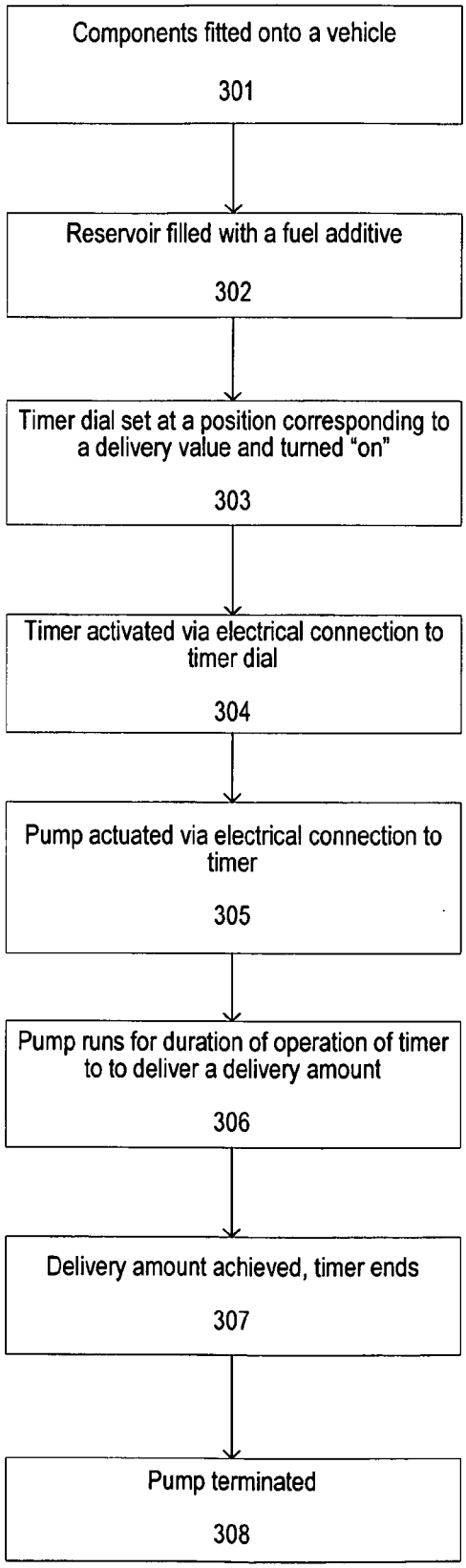
FIG. 3 is a flow chart illustrating one method embodiment for operating a fuel additive storage and delivery system.

FIG. 3 outlines an exemplary method 300 of operating the fuel additive storage and delivery system. Method 300 commences when components are fitted onto a vehicle, in step 301. These components, for example, include reservoir

102, pump 118, tubular members 112 and 120, along with their valves 114, 116 and 122, 124, timer 130 and user interface 138. Pump 118 is, for example, a volumetric pump in fluidic communication with reservoir 102 and fuel return line 126, via tubular members 112 and 120 and valves 114, 116 and 122 and 124.

Reservoir 102 is filled with a selected fuel additive, for example, a deicer or cetane booster, in step 302. In step 303, the user interface (i.e., user interface 138) is set at a position corresponding to a desired delivery value, and turned "on". A timer (i.e., timer 130) is activated via electrical connection to user interface, in step 304. The timer then actuates the pump (i.e., pump 118) via an electrical connection between the timer and the pump, in step 305. In step 306, the pump is run for a duration of operation of the timer, to deliver the delivery amount in accordance with Equation 1. For example, the pump is run at a known rate, for a known time, in order to deliver a desired, predetermined volume of fuel additive.

In step 307, the desired delivery amount is achieved and the timer ends. The pump is terminated in step 308, and delivery of the fuel additive is complete.

The present invention in its broader aspects is not limited to the specific embodiments shown and described herein. Those skilled in the art may appreciate that various insubstantial changes and modifications may be made to the disclosed embodiments without departing from the scope of the invention as described herein. By way of example, what is disclosed may be broadly applied to the addition of fuel additives to gasoline, diesel, biodeisel, alcohol, or other fuels, even in non-automotive applications. The inventors hereby state their intent to rely upon the Doctrine of Equivalents to protect the invention.

What is claimed is:

1. A system for storage and delivery of a fuel additive to a fuel tank, comprising:

a reservoir configured to store the fuel additive for delivery;

a pump that is operable to pump the fuel additive, the pump having a rate of output that is within an effective range for delivery of the fuel additive;

means for placing the pump in fluidic communication with the reservoir to deliver fuel additive from the reservoir to the pump when the pump is operating to deliver the fuel additive;

means for establishing fluidic communication between the pump and a fuel return line of a vehicle to deliver the fuel additive to the fuel return line and the fuel tank when the pump is operating for delivery of the fuel additive; and a timer that is electrically connected to the pump for actuation of the pump to provide a volumetric output from the pump according to a predetermined amount of fuel additive that is needed for combination with fuel in the fuel tank; and a user interface for control of the timer.

2. The system of claim 1, wherein the user interface has a plurality of user-selectable settings, each setting configured to provide the predetermined amount as a user selectable value.

3. The system of claim 2, wherein the user interface includes a dial that may be positioned by the user to select one of the plurality of settings.

4. The system of claim 2, wherein the plurality of user-selectable settings each identify an amount of fuel that is in need of fuel additive delivery.

5. The system of claim 1 wherein the timer is configured to deliver the predetermined amount by operation of the pump within a suitable margin of error as a product of time and the rate of output.

6. The system of claim 1, further comprising a common housing for the reservoir, the pump and the timer, the means for establishing fluidic communication between the pump and a fuel return line extending through the housing.

7. The system of claim 6, wherein the housing further comprises electrical portals for at least two electrical wires configured to supply power to the system for operation of the timer and the pump.

8. The system of claim 6, further comprising a mounting bracket configured for support of the housing within a vehicle engine compartment.

9. The system of claim 1, provided as a retrofit assembly that is capable of being suitably installed in a predetermined model of vehicle.

10. The system of claim 9, the retrofit assembly including means for mounting the system on an attachment point selected from the group consisting of a vehicle firewall and a fender.

11. The system of claim 1, the timer including a rheostat mechanism.

12. The system of claim 1, the timer further comprising a selectively adjustable timer calibrated to the rate of output to provide a selected pump output volume.

13. The system of claim 1, wherein the user interface includes a timer dial configured for mounting in a vehicle's driver compartment and electrically connected to the timer by electrical wiring, the timer dial further comprising a toggle switch and volumetric settings for setting the timer dial to a volumetric setting corresponding to a volume of fuel added to a fuel tank of the vehicle, each volumetric setting further corresponding to a duration of the timer.

14. The system of claim 13, the timer dial further comprising an on/off switch and an on/off indicator light.

15. The system of claim 1, the reservoir further comprising:

an additive portal for adding the fuel additive;

a removable, vented cap for opening and closing the additive portal;

a check valve seal, functional to prevent fumes from escaping from the reservoir while allowing suction from the pump to draw air into the reservoir; and a drain portal disposed in the reservoir, for draining the contents of the reservoir.

16. The system of claim 1, wherein the means for placing and the means for establishing each include a steel braided hose covered with an insulator material.

17. The system of claim 1, where in the means for establishing includes a self-sealing piercing valve for use in coupling with the fuel return line to establish a fluidic pathway.

18. The system of claim 1, wherein the means for placing includes a tubular member and a check valve that prevents reverse flow along a fluidic pathway between the reservoir and the pump.

19. A method of operating a fuel additive storage and delivery system, the method comprising the steps of:

fitting onto a vehicle components including:

a reservoir configured to store the fuel additive for delivery;

a pump that is operable to pump the fuel additive, the pump having a rate of output that is within an effective range for delivery of the fuel additive;

means for placing the pump in fluidic communication with the reservoir to deliver fuel additive from the reservoir to the pump when the pump is operating to deliver the fuel additive;

means for establishing fluidic communication between the pump and a fuel return line of a vehicle to deliver the fuel additive to the fuel return line and the fuel tank when the pump is operating for delivery of the fuel additive;

a timer that is electrically connected to the pump for actuation of the pump to provide a volumetric output from the pump according to a predetermined amount of fuel additive that is needed for combination with fuel in the fuel tank; and a user interface for control of the timer;

filling the reservoir with a fuel additive;

setting the timer dial at a position corresponding to a delivery value selected from the group consisting of an amount of fuel additive to be delivered and an amount of fuel to be treated; and operating the pump to deliver the delivery amount.

20. A system for storage and delivery of a fuel additive to a fuel tank, comprising:

an enclosed, vented reservoir configured to store the fuel additive for delivery;

a pump that is operable to pump the fuel additive, the pump having a rate of output that is within an effective range for delivery of the fuel additive;

means for placing the pump in fluidic communication with the reservoir to deliver fuel additive from the reservoir to the pump when the pump is operating to deliver the fuel additive;

means for establishing fluidic communication between the pump and a fuel return line of a vehicle comprising insulated, steel-braided hose connected to the fuel return line by means of a self-sealing piercing valve to deliver the fuel additive to the fuel return line when the pump is operating for delivery of the fuel additive; and a timer that is electrically connected to the pump for actuation of the pump to provide a volumetric output from the pump according a predetermined amount of fuel additive that is needed for combination with fuel in the fuel tank; and a programmable user interface including program instructions facilitating user entry of data to control operation of the timer for a user-selected additive dilution ratio according to a mathematical algorithm;

a common housing for the reservoir, pump, and timer, including portals for electrical wires;

an assembly system comprising a mounting bracket and hardware configured to support the housing within a vehicle engine compartment.

* * * * *